US006383062B1

(12) United States Patent
Jou

(10) Patent No.: US 6,383,062 B1
(45) Date of Patent: May 7, 2002

(54) SANDBLASTING GUN

(76) Inventor: Wuu-Cheau Jou, No. 95, Cheng Kung 2nd Road, Taili City, Taichung Hsien (TW)

( * ) Notice: Subject to any disclaimer, the term of this patent is extended or adjusted under 35 U.S.C. 154(b) by 0 days.

(21) Appl. No.: 09/584,773

(22) Filed: Jun. 1, 2000

(51) Int. Cl.[7] ..... B24C 3/00

(52) U.S. Cl. ..... 451/90; 451/102; 239/375; 239/379; 239/526

(58) Field of Search ..... 451/90, 102; 239/375–379, 239/526

(56) References Cited

U.S. PATENT DOCUMENTS

| | | | | | |
|---|---|---|---|---|---|
| 2,133,149 | A | * | 10/1938 | Poncelet | 451/90 |
| 2,305,976 | A | * | 12/1942 | McKnight | 451/90 |
| 2,526,403 | A | * | 10/1950 | Paasche | 451/90 |
| 2,577,465 | A | * | 12/1951 | Jones et al. | 451/90 |
| 2,792,671 | A | * | 5/1957 | Sprigg et al. | 451/102 |
| 2,801,133 | A | * | 7/1957 | Ridley | 451/102 |
| 3,276,168 | A | * | 10/1966 | Ashworth | 451/90 |
| 3,624,966 | A | * | 12/1971 | Palmer | 451/90 |
| 4,048,918 | A | * | 9/1977 | Peck | 451/90 |
| 4,090,334 | A | * | 5/1978 | Kurowski et al. | 451/90 |
| 4,628,644 | A | * | 12/1986 | Somers | 451/90 |
| 5,054,249 | A | * | 10/1991 | Rankin | 451/102 |
| 5,181,349 | A | * | 1/1993 | Schaffer | 451/75 |

* cited by examiner

*Primary Examiner*—M. Rachuba
(74) *Attorney, Agent, or Firm*—Rosenberg, Klein & Lee

(57) ABSTRACT

The present invention provides a sandblasting gun, in which by assembling an adapter, a blast head assembly in securing connection sequentially on a tool gun front end; said blast head assembly holds a blast nozzle in the inside of a tap hole at the back end of the main body, thereby a jet exhaust of the blast nozzle jetting high compressed air to generate a sucking force in the pipeline; at the front end of the main body, an extended male thread is provided for securing an end nut to hold a blast tube, a extended scavenging gun-barrel or a spray adapter in to combine a sandblasting gun, a spraying gun or a cleaning gun for meet multipurpose in operation.

2 Claims, 14 Drawing Sheets

SANDBLASTING GUN

BACKGROUND OF THE INVENTION

1. Field of the Invention

The present invention relates to a sandblasting gun, and more particularly to a sandblasting gun having multifunction integrated with sandblasting, cleaning and simple spray painting together.

2. Description of Prior Art

In accordance with the conventional sandblasting gun 10, as shown on FIG. 1 and FIG. 2, a blasting portion 12 is attached on the end side of a square gun head 11 by a blast nozzle 13 secured in the inside of the square gun head 11 from the inside of the blasting portion 12, and for locating and preventing the blasting portion 12 from turning, a stopper 121 is formed on the end of the blasting portion 12. On the other end of the blasting portion 12, a sleeve nut 14 secures a blast head 15 on the front end of the blasting is portion 12. On the bottom side, the blasting portion 12 extends a tube connection 122 downward to join with a sleeve 16 in socket connection, and another end of the sleeve 16 connects a metal tube 17 in the same connection so that the bottom end of the metal tube 17 is buried into a sand tank 18. As compressed air is jet out from the blast nozzle 13, a siphon force will be generated in the inside of the pipeline to suck the sand into the inside of blasting portion 12 to mix with air and jet out form the blast head 15 in high speed to be used for polishing the metal surface of the parts, rusting removal or burnishing raw edge processing.

But above-mentioned sandblasting gun has following shortcomings:

1. Although preventing the blasting portion 12 from turning of the stopper 121 is an advantage, but meanwhile it restricts other function development, so it just suits to siphon structure, but no way to change to gravity-feed structure.
2. Securing the blast nozzle 13 in the inside of the blasting portion 12 has to employ a special tool to use in the narrow space, which is owned by the manufacturer so that the consumer can not disassembly by themselves at will. So as the blast nozzle 13 is getting to be wore out by jet sand, the whole sandblasting gun will have to be rejection, the consumer have to buy a new one.
3. Above-mentioned sandblasting gun 10, due to the limitation of the length of the siphon pipe about 2 meters, is restricted in a small range for keeping an essential siphon force. If processing on a big workpiece, it has to connect several sandblasting guns in serial.
4. Due to the limitation of the siphon force of above-mentioned sandblasting gun, the fine sand can be sucked into the inside of the blasting portion 12, but not suit to open sand.
5. Due to the single function of above-mentioned sandblasting gun 10, the consumer has to buy other tool guns to meet the necessaries of cleaning or spraying paint.

OBJECTS AND SUMMARY OF THE INVENTION

It is therefore a main object of the present invention to provide a sandblasting gun that integrates sandblasting, cleaning and spraying painting functions together in one body so that the extra value of the product is increased, meanwhile the customers save their money on buying similar tools.

It is a next object of the present invention to provide a sandblasting gun, in which the blast head can be disassembled easy for replacing or cleaning. So it is easy to be maintenance so that the service life of this product is postponed.

It is a next object of the present invention to provide a sandblasting gun, in which the blast head can be turned in any direction and adapts both jet states including siphon feed and gravity feed state to meet the necessary of any working environment.

It is a other object of the present invention to provide a sandblasting gun, in which the connection stand of the blasting main body not only can join with pipe adapter, but although a long pipeline about 25 meters, meanwhile it can join to can style of sand or paint in operation, in order to make jet open sand or high density paint be possible in gravity feed state.

These objects are achieved by assembling an adapter, a blast head assembly in securing connection sequentially on a tool gun front end; said blast head assembly holds a blast nozzle in the inside of a tap hole at the back end of the main body, thereby a jet exhaust of the blast nozzle jetting high compressed air to generate a sucking force in the pipeline; at the front end of the main body, an extended male thread is provided for securing an end nut to hold a blast tube, a extended scavenging gun-barrel or a spray adapter in to combine a sandblasting gun, a spraying gun or a cleaning gun for meet multipurpose in operation.

DETAILED DESCRIPTION OF PREFERRED EMBODIMENTS

Figure 1:
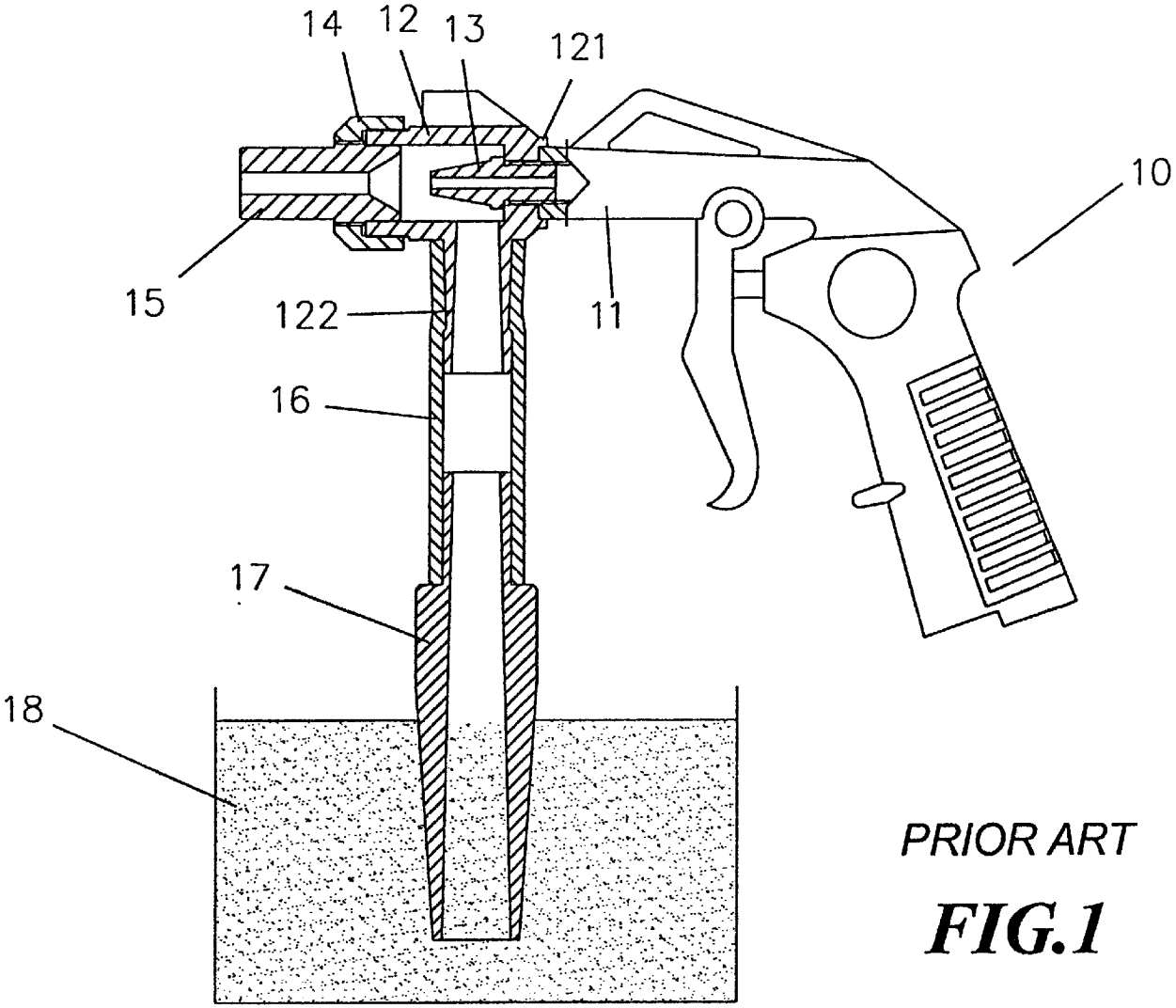
PRIOR ART FIG.1
FIG. 1 is a part cross-section side view of the prior art.
Figure 2:
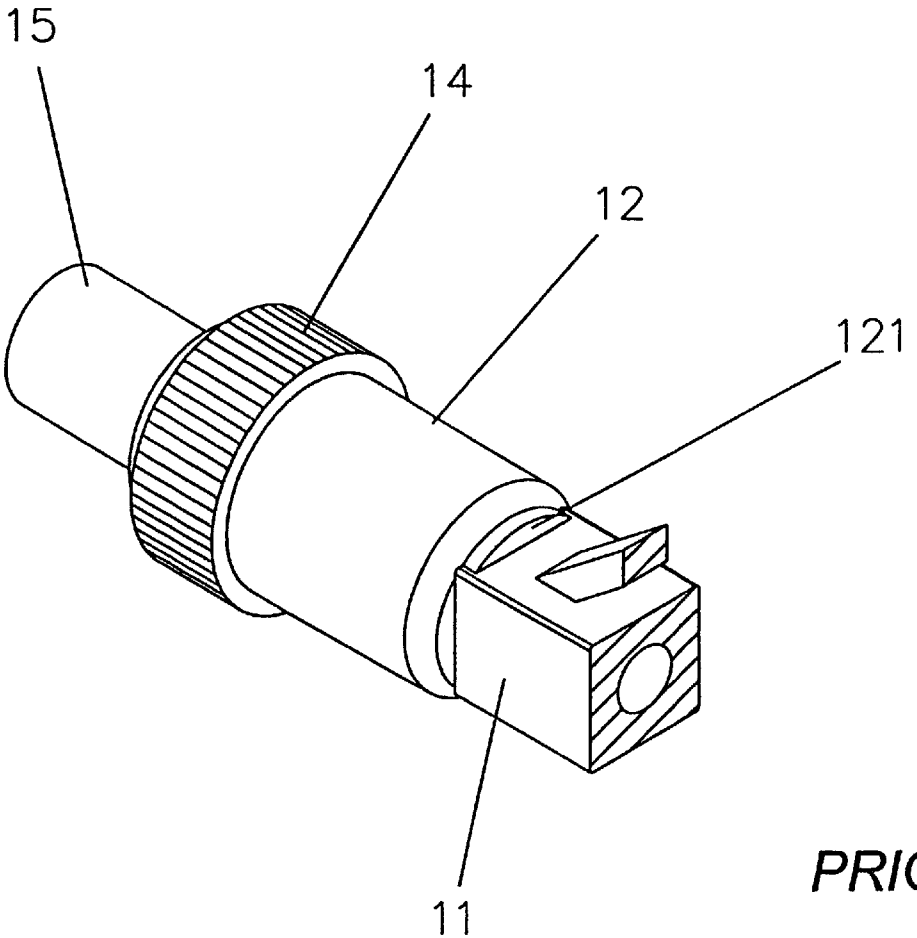
PRIOR ART FIG.2
FIG. 2 is a solid view showing the sandblasting portion of the prior art.
Figure 3:
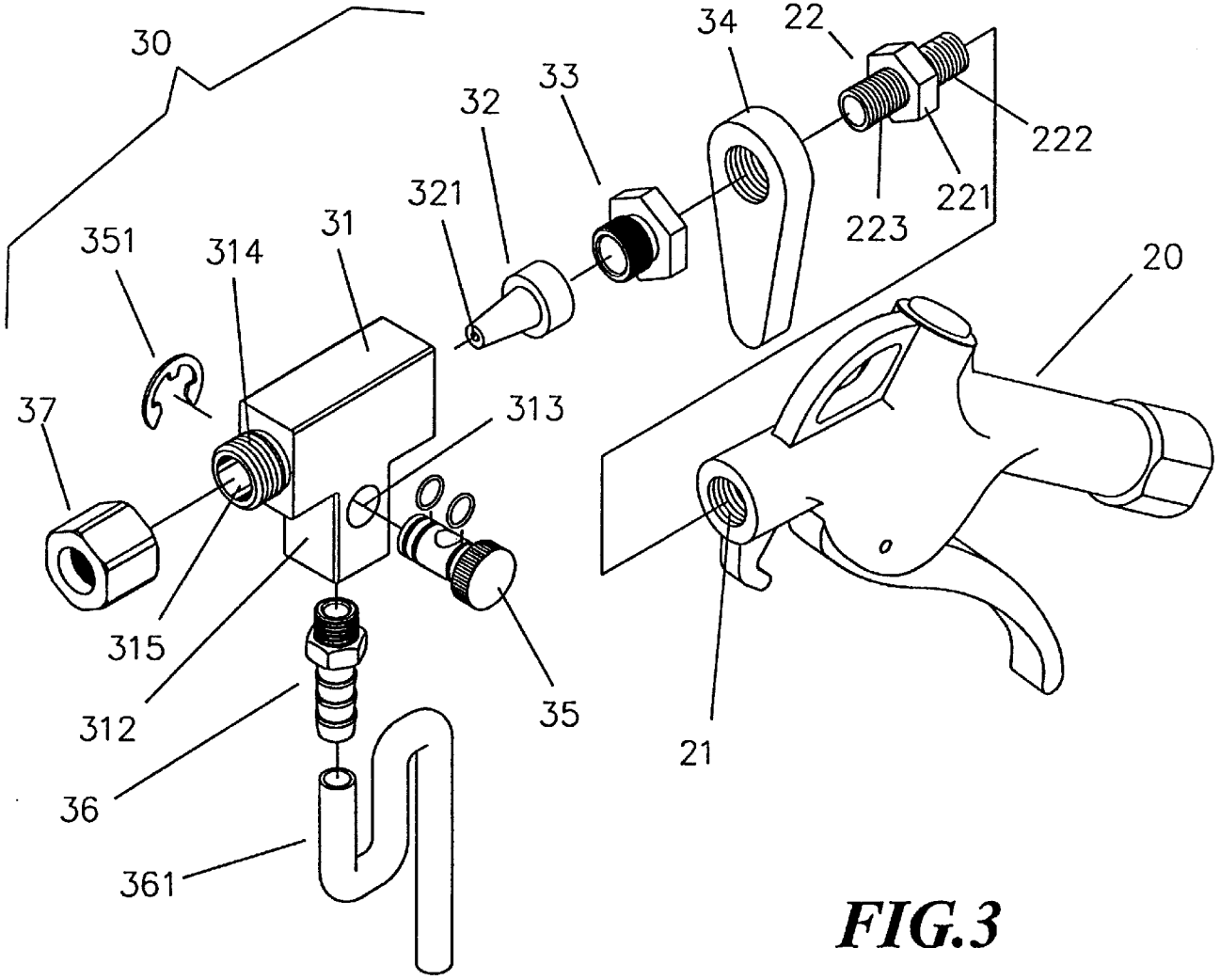
FIG. 3 is an exploded view of the present invention.
Figure 4:
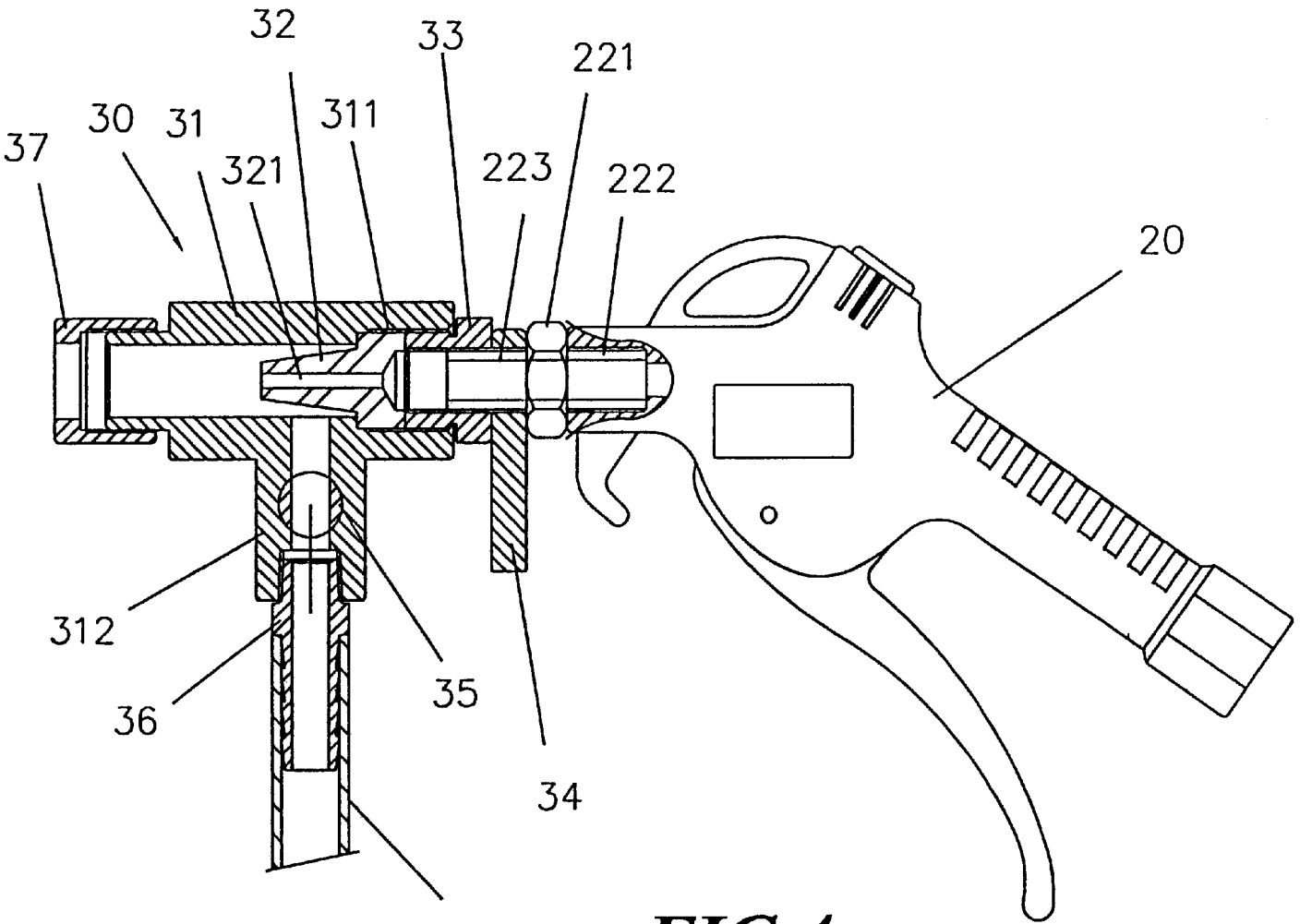
FIG. 4 is a cross-section view of the present invention.

Referring to FIG. 3 and FIG. 4, the present invention includes a common tool gun 20 as same as a traditional air spraying gun, with a tap hole 21 on the front end for securing a pipe adapter 222 in, said pipe adapter 22 is a double-head hex bolt including a hexagon head 221 at middle and two male threads 222 223 at both sides for securing into the inside of the tap hole 211 of the tool gun 20 and a blast head assembly 30 separately; wherein, said blast head assembly 30 includes a main body 31 holding a blast nozzle 32 in the back side tap hole 311; said blast nozzle 32 has a jet exhaust 321 with cone mouth in the front end, and is located by a connector 33 secured into said tap hole 311; said connector 33 has a through tap hole with a female thread 331 for joining with the male thread 223 of the pipe adapter 22, and is adjusted in any direction on 360° round space; and between the connector 33 and the hexagon head 221, a handle nut 34 is placed on the male thread 223 with a female thread, thereby it to secure the main body 31 on in any direction; said main body 31 extends a connection stand 321 downward, and a through-hole 313 crossing the connection stand 321 for fitting in a throttling cock 35 located by a retainer ring 351, and a tap hole at the bottom side for securing a pipe adapter 36 in; the another end of the pipe adapter 36 connects to a pipe-line 361 in plug-socket joint; on the front end, said main body 31 extends out a male thread 314 for securing a end nut 37 on for locating a blast pipe 40 or a scavenging barrel 50 or a spraying adapter 60 in front end of the through-hole 315 of the main body 31 to combine a sandblasting gun, a cleaning gun or a spraying paint gun.

In accordance with above-mentioned features of the present invention, the tool gun can be combined into several operations in different applications:

Sandblasting Gun Operation

Figure 5:
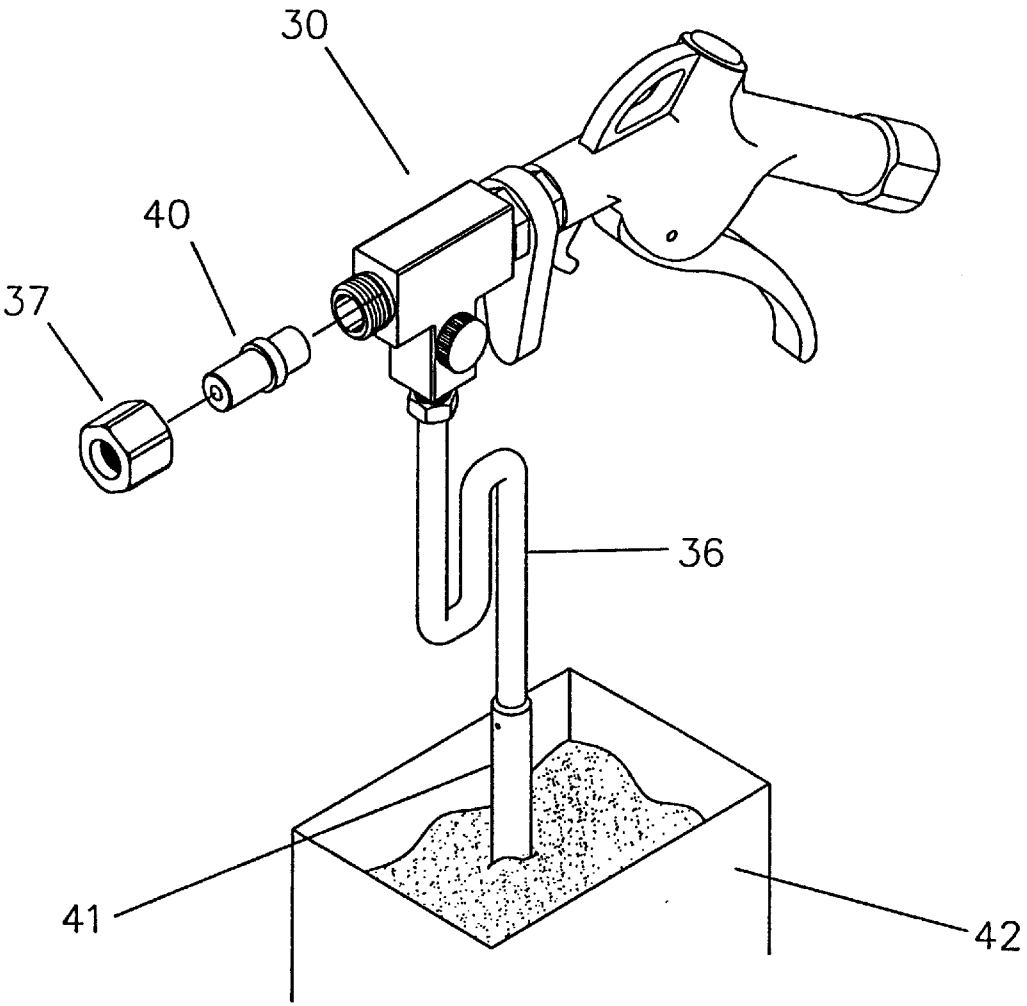
FIG. 5 is a solid view showing an operation of the sandblasting gun of the present invention.
Figure 6:
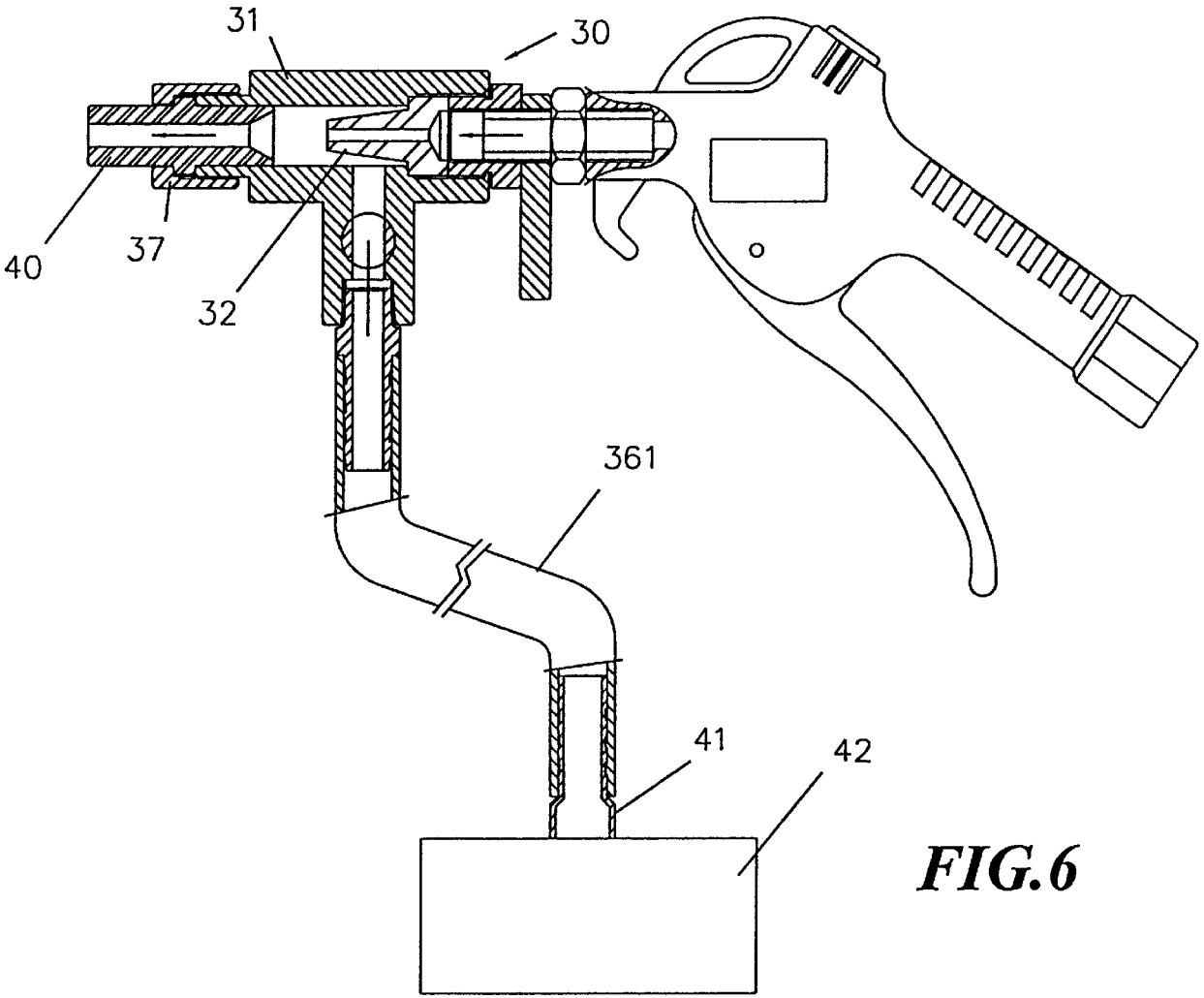
FIG. 6 is a cross-section view showing FIG. 5 of the present invention.

Referring to FIG. 5 and FIG. 6, a blast pipe 40 is secured on the front end of the blast head assembly 30 by the end nut 37; and a metal tube 41 is joined on the bottom end of the pipeline 361 with one end, the another end of the metal tube 41 is buried into the sand contained in the sand tank 42; by high speed flow of the compressed air jet out, a sucking force is generated in the pipeline so that the sand in the sand tank 42 is sucked into the inside of the main body 31 to mix with the air and jet out to shoot on the metal surface of the working part to polish or to rust removal or to burnish raw edge.

Figure 7:
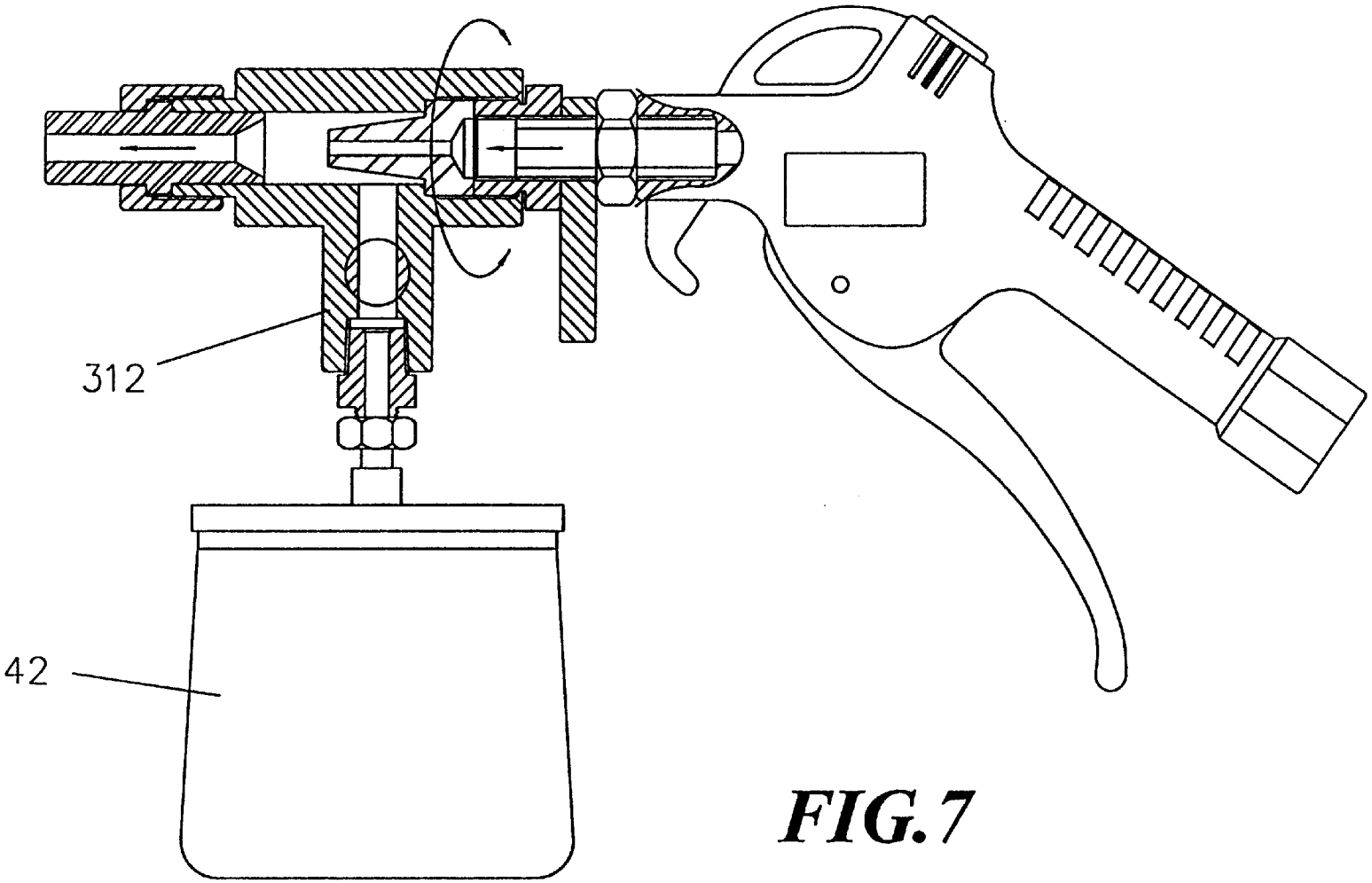
FIG. 7 is a cross-section view showing a sandblasting gun working with a sand can of the present invention.

Referring to FIG. 7, in this operation of the present invention, the connection stand 312 connects a sand can 43 in screw connection so that the sandblasting gun is operated more conveniently without the limitation of the length of the pipeline 361, it can be carried in any height or on any angle in operation.

Figure 8:
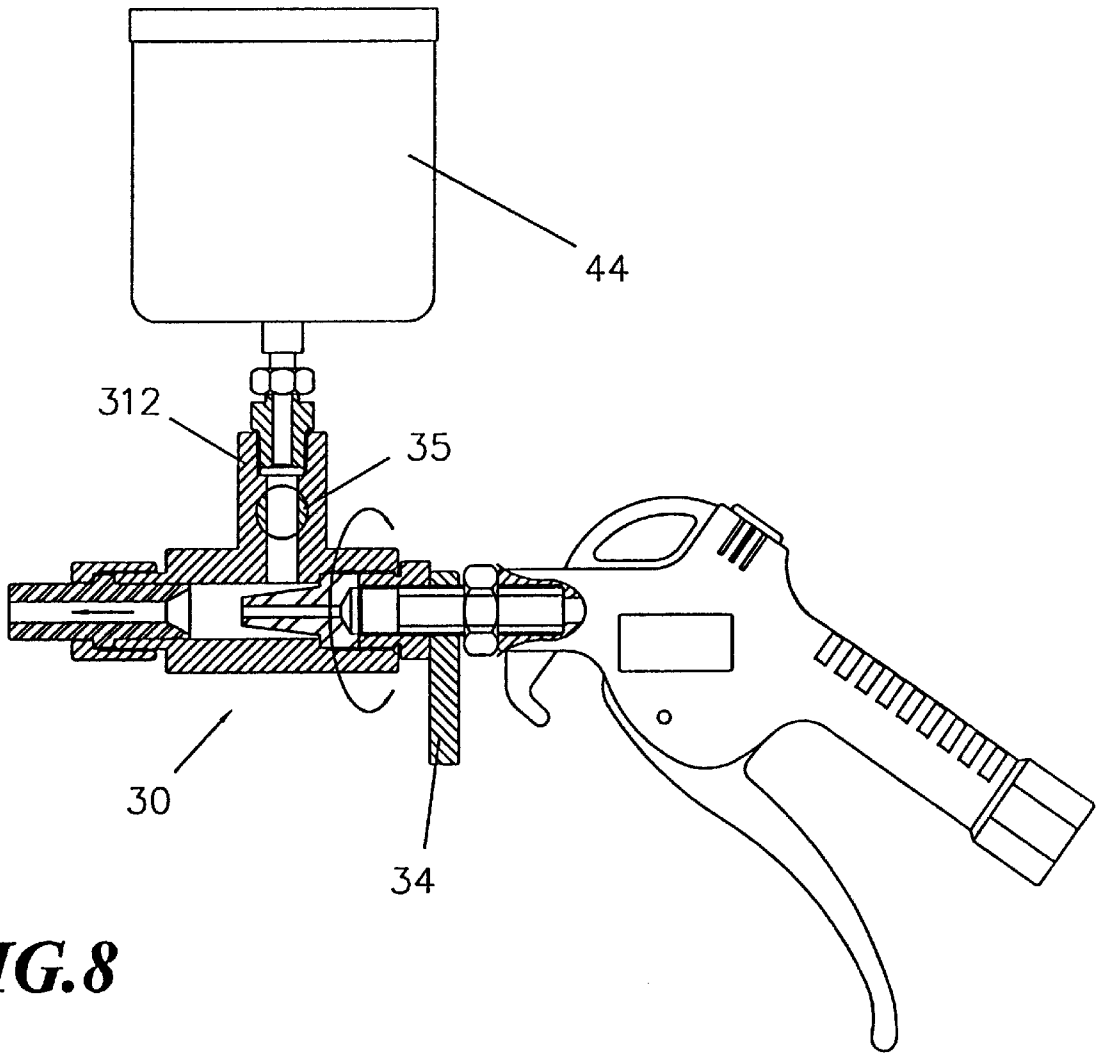
FIG. 8 is a cross-section view showing a sandblasting gun working with a gravity-feed sand can of the present invention.

Referring to FIG. 8, because the position of the main body 31 can be adjusted in any angle by releasing the handle nut 34 and locking it again as the main body 31 getting the desired position, the sand can 44 can be adjusted on upside down and locked again to form a gravity feed sandblasting gun. By adjusting the throttling cock 35 to control the sand flow, the sand could not drop into the inside of the main body 31 as it is in idle state.

Cleaning Gun Operation

Figure 9:
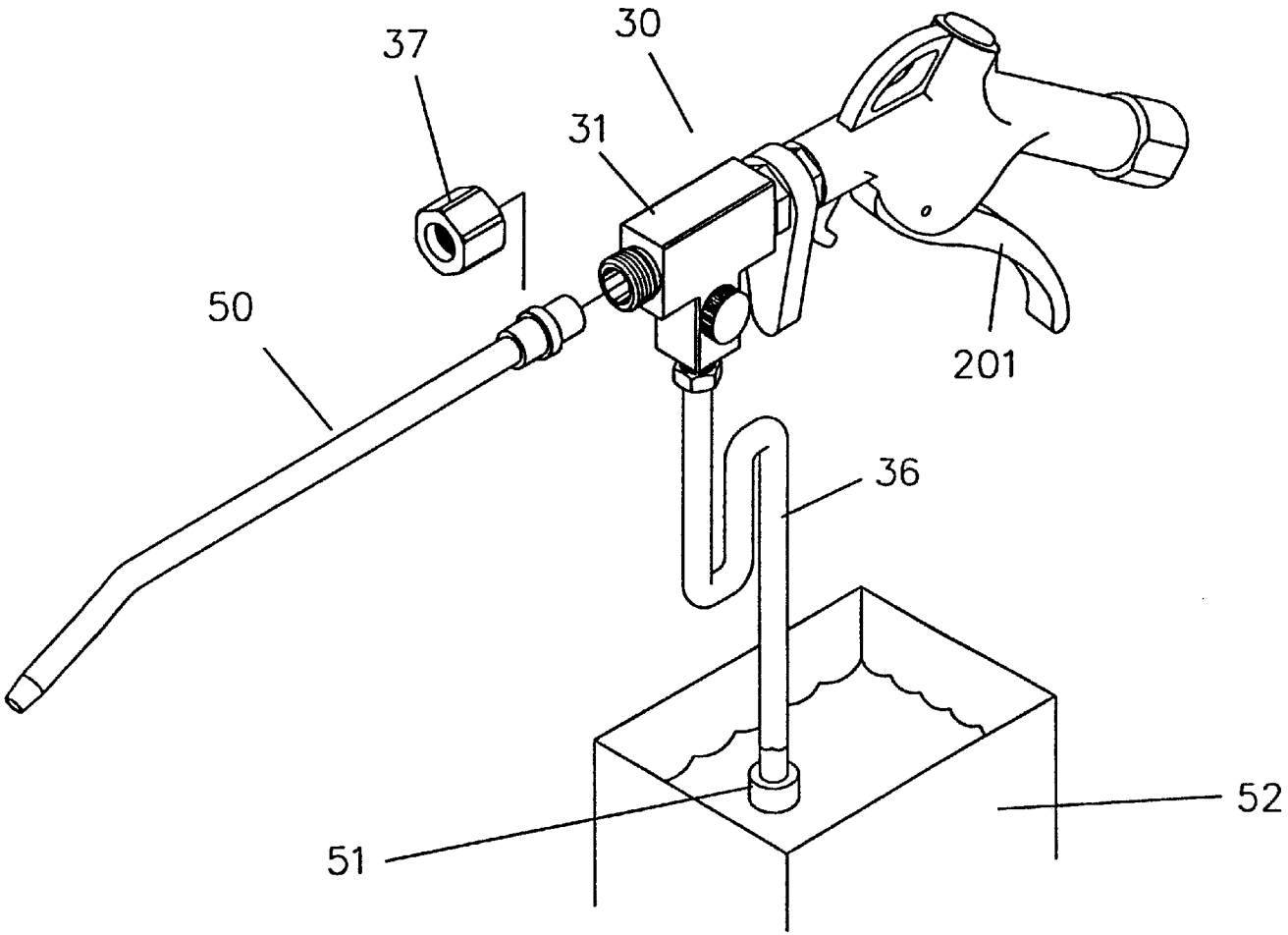
FIG. 9 is an exploded solid view showing an operation combining to a cleaning gun of the present invention.
Figure 10:
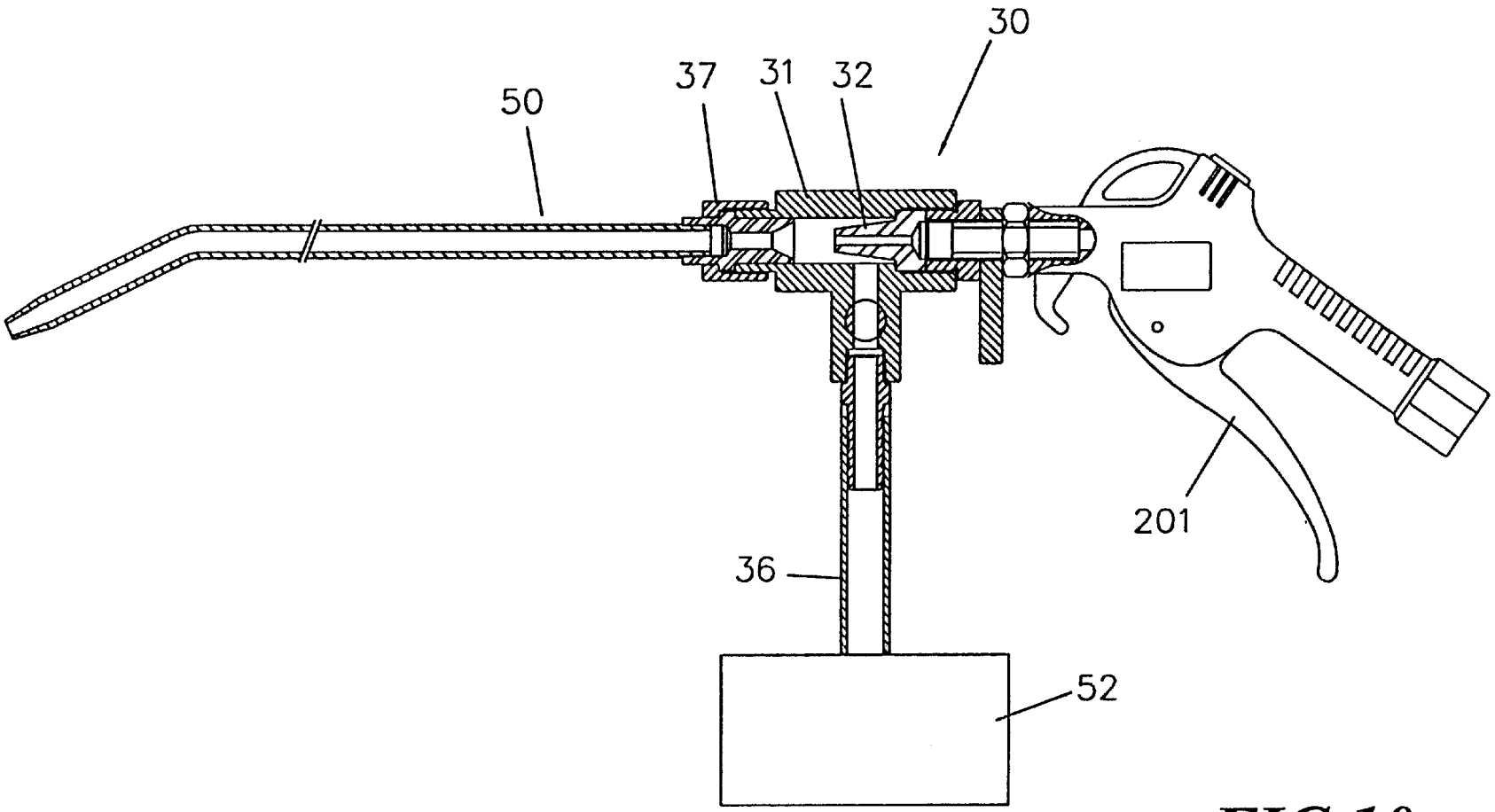
FIG. 10 is a cross-section view showing FIG. 10 of the present invention.

Referring to FIG. 9 and FIG. 10, a scavenging gun-barrel 50 is secured on the front end of the blast head assembly 30 by the end nut 37; said scavenging gun-barrel 50 can be turned to relocate the direction of the front bend jet mouth in any desired position; the pipeline 36 connects to a filter head 51 at the bottom end, which sinks into the cleaned liquid contained in the tank 52; by controlling the handle 201 of the tool gun, the compressed air is jet out from the blast nozzle 32 to the inside of the main body 31 to generate a siphon force in the pipeline, so the liquid is sucked into the inside of the main body 31 via the pipeline to mix with the air in there, then the mixed liquid is jet out in high speed via the scavenging gun-barrel 50 to perform the cleaning process; this cleaning gun can shoot out 19 gallons liquid in one hour higher than the traditional super cleaning gun(16 gallons/hour), so the cleaning efficiency is increased relatively.

Spraying Paint Gun Operation

Figure 11:
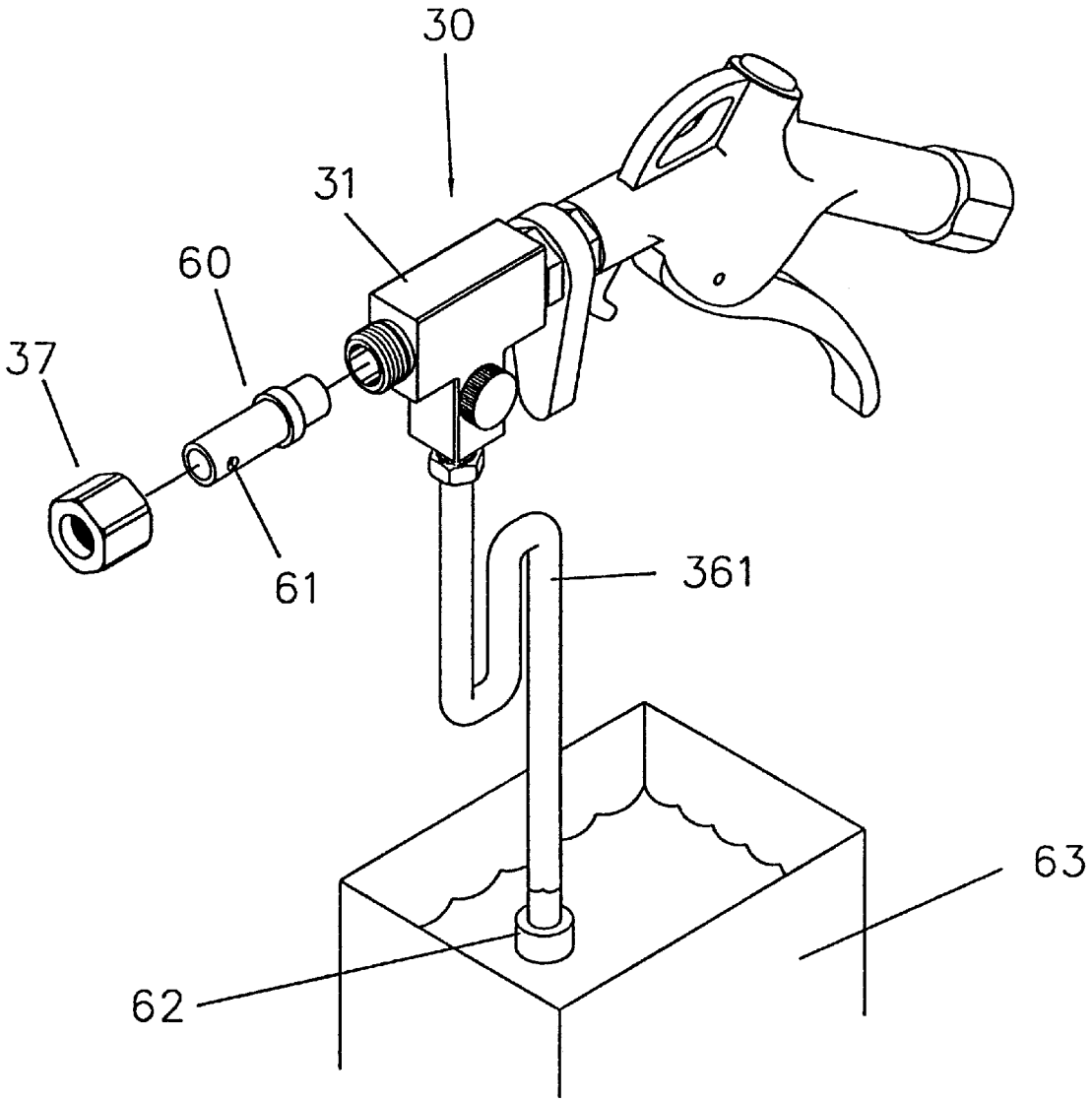
FIG. 11 is an exploded solid view showing an operation combining to a spraying gun of the present invention.
Figure 12:
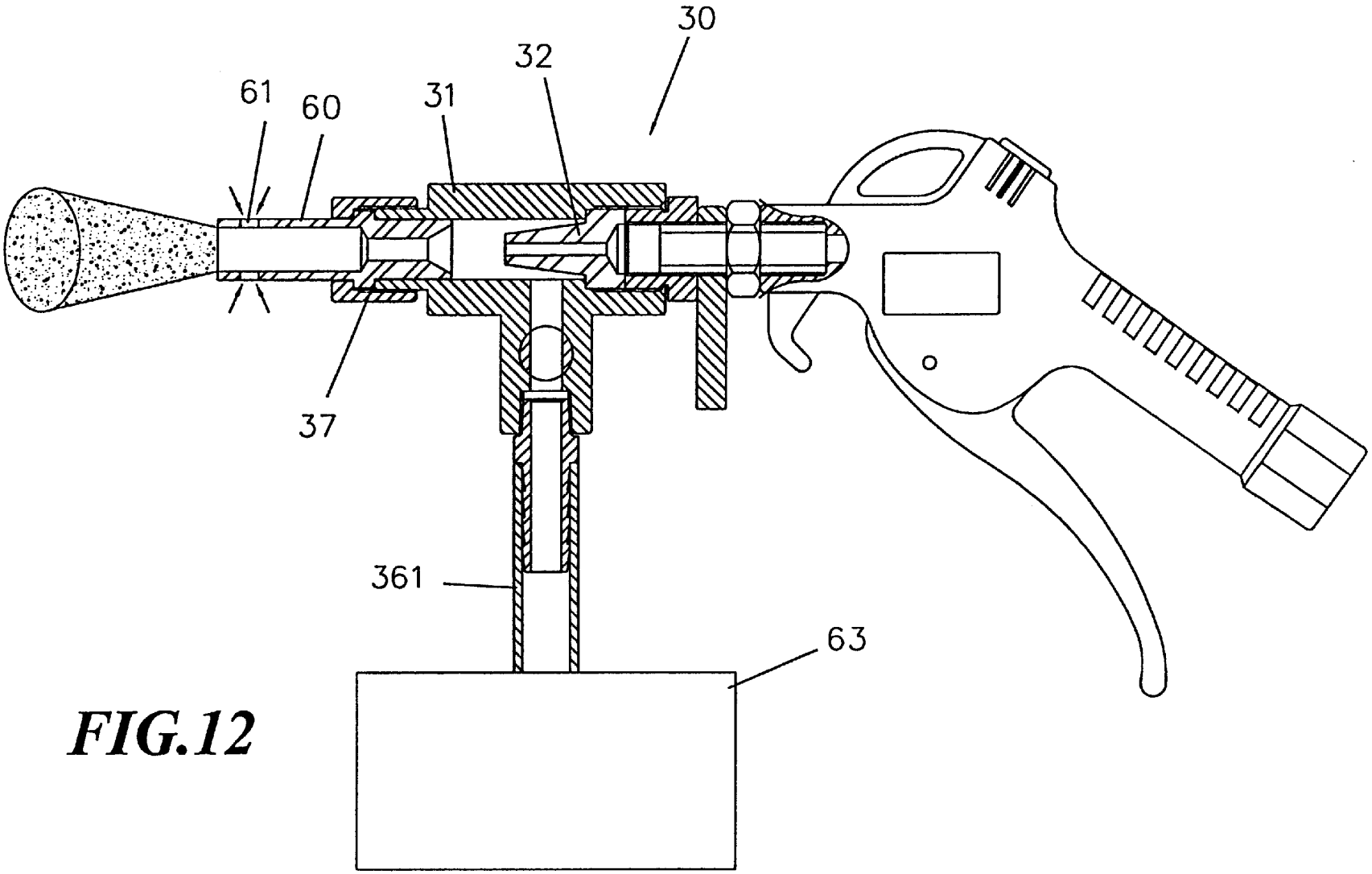
FIG. 12 is a cross-section view showing FIG. 11 of the present invention.

Referring to FIG. 11 and FIG. 12, a spray adapter 60 is located on the front end of the blast head assembly 30 by securing the end nut 37; said spray adapter 60 has a side crossing hole 61 nearing the front end; a filter head 62 is attached on the bottom end of the pipeline 361 sinking into the paint contained in a paint tank 63 to form a spraying gun; as the compressed air is jet out from the blast nozzle 32, the paint is sucked in the inside of the maim body 31 to mix with the air via the pipeline 361, meanwhile by means of the side crossing hole 61, the air is sucked into the inside to help the paint spraying; and by adjusting the throttling cock 35, the proportion of paint and the air can be changed in order to control the paint consistency.

Figure 13:
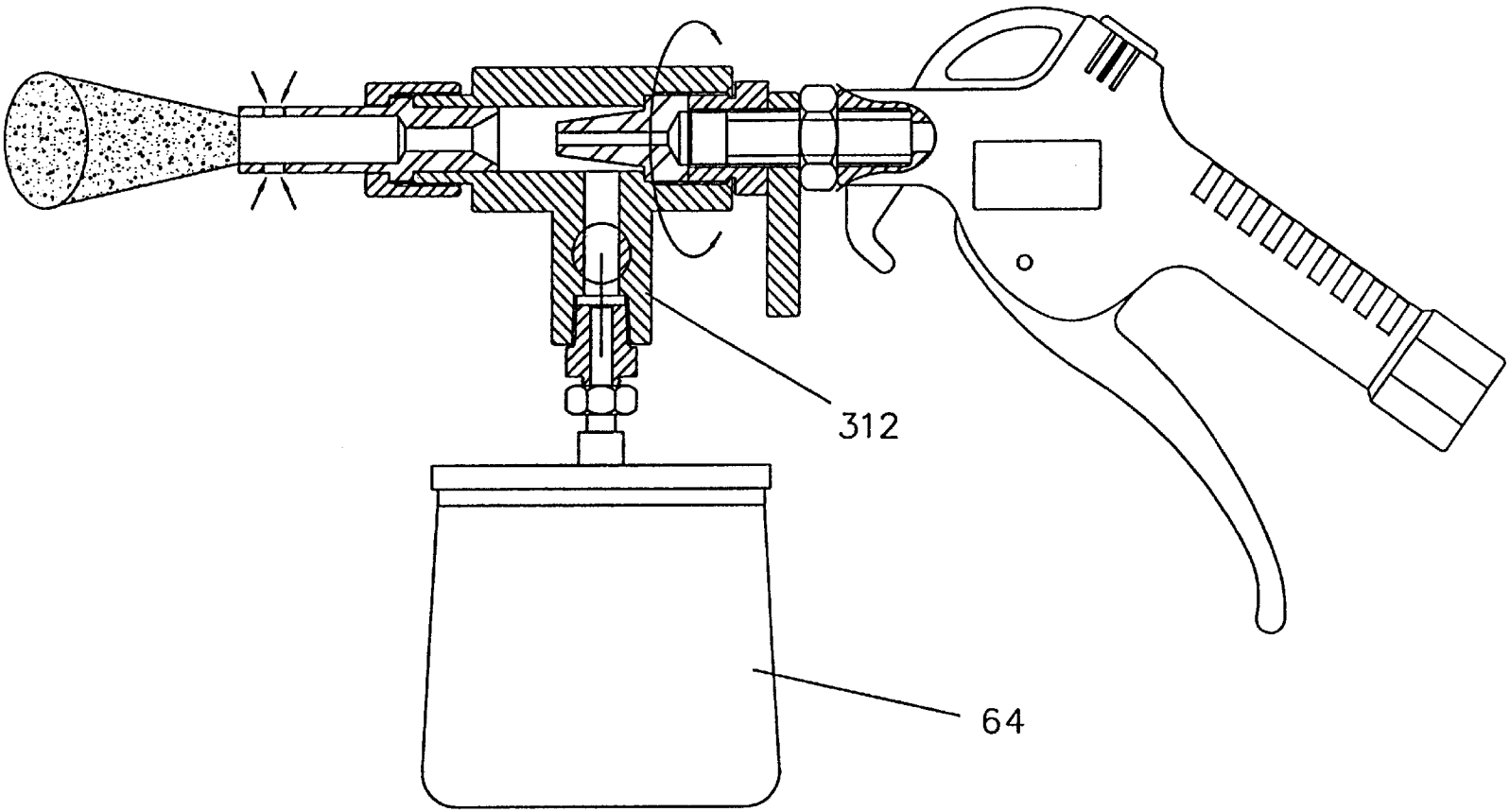
FIG. 13 is a cross-section view showing an operation of a spraying gun working with a siphon paint can of the present invention.

Referring to FIG. 13, this is an operation of the spraying gun with a paint can of the present invention, wherein the connection stand 312 connects with a paint can 64 in securing connection to form a paint can style spraying gun so that it has more convenient in performance to suit different working environments.

Figure 14:
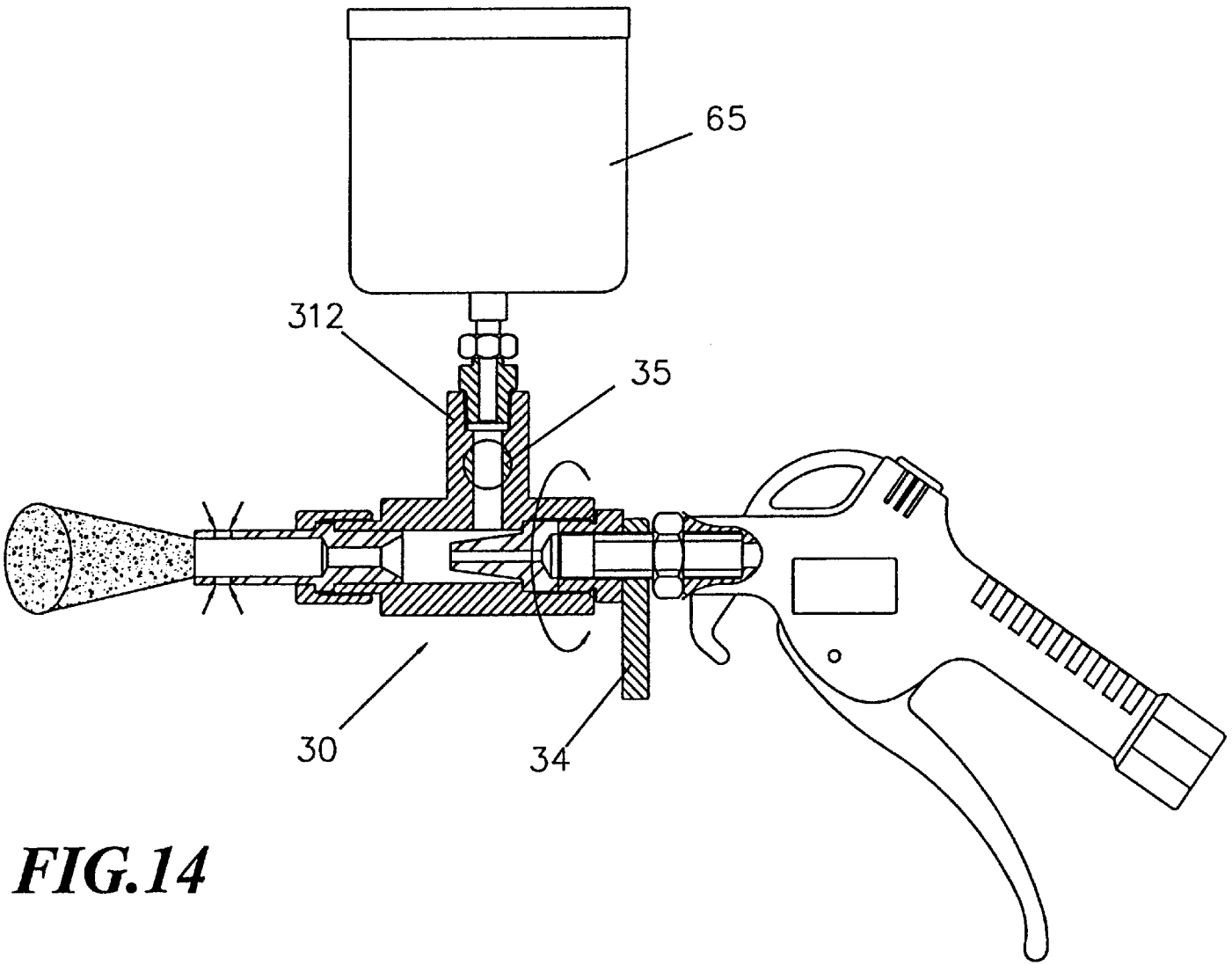
FIG. 14 is a cross-section view showing an operation of a spraying gun working with a gravity paint can of the present invention.

Referring to FIG. 14, shown a gravity-feed paint can spraying gun operation, wherein release the handle nut 34, and turn the main body 31 so that the paint can 64 is in upside down position, and adjust the throttling cock 35 to control the flow of the paint to form a gravity-feed paint can spraying gun.

I claim:

1. A reconfigurable blast and spray assembly comprising:

(a) a tool gun for generating a pressurized pneumatic stream responsive to user actuation, said tool gun including a tap hole formed at a front end portion thereof;

(b) a first pipe adapter coupled to said tool gun, said first pipe adaptor including an intermediate head and a pair of tubular threaded sections extending axially therefrom in opposed directions, an inner one of said tubular threaded sections coaxially engaging said tap hole of said tool gun front end portion;

(c) a blast head assembly coupled in angularly adjustable manner to said first pipe adapter, said blast head assembly including:

(1) a main body defining an inner chamber and a tap hole communicating therewith, said main body having projecting therefrom an outlet portion and a connection stand portion, said outlet and connection stand portions communicating with said inner chamber;

(2) a blast nozzle disposed at least partially in said inner chamber, said blast nozzle having a jet exhaust portion defining a cone mouth front end;

(3) a connector engaging said main body tap hole to retain said blast nozzle at least partially within said inner chamber, said connector having an axially extended through hole coaxially receiving an outer one of said first pipe adapter tubular threaded sections;

(4) a handle nut disposed between said connector and said intermediate head of said first pipe adapter, said handle nut engaging said outer tubular threaded section of said first pipe adapter; and, (5) a throttling cock extending transversely into said connection stand portion of said main body;

(d) a second pipe adapter connecting an open terminal end of said main body connection stand portion to a blast material source pipe-line member; and, (e) a preselected attachment member coupled to said outlet portion of said blast head assembly main body for expelling a preselected blast material.

2. The reconfigurable blast and spray assembly as recited in claim 1 wherein said attachment member is selected from the group consisting of: a blast pipe, a scavenging barrel, and a spraying adapter.

* * * * *